US005855276A

United States Patent [19]

Smith, Jr.

[11] Patent Number: 5,855,276

[45] Date of Patent: Jan. 5, 1999

[54] CARRIER FOR ITEMS

[76] Inventor: Gerald Vincent Smith, Jr., 9608 Pamelia Pl., Fort Washington, Md. 20748

[21] Appl. No.: 977,894

[22] Filed: Nov. 25, 1997

Related U.S. Application Data

[60] Provisional application No. 60/031,231 Nov. 25, 1996.

[51] Int. Cl. [6] ..... B65D 30/10; A45C 3/00

[52] U.S. Cl. ..... 206/457; D3/235; 150/117; 190/111; 206/542

[58] Field of Search ..... 150/107, 112, 150/117; 190/109, 111; 206/305, 314, 320, 457, 541, 542, 581; 446/73–78, 302, 396, 29; D3/235, 236, 238, 270, 271

[56] References Cited

U.S. PATENT DOCUMENTS

| | | | |
|---|---|---|---|
| D. 313,118 | 12/1990 | Maddocks . | |
| D. 313,697 | 1/1991 | Senitt . | |
| D. 313,887 | 1/1991 | Senitt . | |
| D. 324,302 | 3/1992 | Schneck . | |
| D. 324,304 | 3/1992 | Senitt . | |
| D. 340,578 | 10/1993 | Winkos | D3/271 |
| D. 345,649 | 4/1994 | Beltempo . | |
| D. 352,391 | 11/1994 | Beltempo . | |
| D. 358,476 | 5/1995 | Winkos . | |
| 1,630,844 | 5/1927 | Hall | 446/74 |
| 2,052,594 | 9/1936 | Antell | 446/73 |
| 2,533,850 | 12/1950 | Syracuse | 150/117 |
| 2,549,695 | 4/1951 | Linder | 150/107 |
| 4,886,150 | 12/1989 | Fitzsimmons . | |
| 5,215,172 | 6/1993 | Stevenson . | |
| 5,255,834 | 10/1993 | Bendersky | 206/457 |
| 5,326,300 | 7/1994 | Sonders | 446/74 |
| 5,439,154 | 8/1995 | Delligatti . | |
| 5,551,569 | 9/1996 | Garvin-Mazzarisi | 206/457 |

FOREIGN PATENT DOCUMENTS

| | | |
|---|---|---|
| 2054388 | 2/1981 | United Kingdom . |
| 87/02554 | 5/1987 | WIPO . |

*Primary Examiner*—Jim Foster
*Attorney, Agent, or Firm*—Richard C. Litman

[57] ABSTRACT

A carrier comprising a bag simulative of an animal includes a plurality of storage compartments for holding baby items. A rigid tray may be provided internally within the main body cavity of the carrier, for the carriage and storage of various bulky articles such as clothing, blankets, diapers, etc. Additional forward and rearward storage areas depend from the main tray, downward into forward and rearward leg areas each of which preferably extend the width of the body, for greater structural strength and storage capacity for the carrier. The forward and rearward areas may each include one or more additional removable supplemental storage racks or trays, for the storage and containment of baby food jars, bottles, etc. One or more of these compartments may be insulated to maintain the cold or heat desired for the storage of a given food product or other article. The carrier may have a smaller bag around its neck for holding a blanket or other item. The smaller bag may be related to the larger bag by having a common theme or similar design, for example a horse bag may have a smaller bag shaped like a feed bag or the like. An audio entertainment system may also be provided within the body of the carrier, preferably within an area offering less readily accessible interior volume, such as the head and/or neck of the simulated animal shape.

15 Claims, 4 Drawing Sheets

CARRIER FOR ITEMS

REFERENCE TO RELATED PATENT APPLICATION

This application claims the benefit of U.S. Provisional patent application Ser. No. 60/031,231, filed on Nov. 25, 1996.

BACKGROUND OF THE INVENTION

1. Field of the Invention

The present invention relates generally to a carrier for items and, more specifically, baby items such as bottles, food containers, medical supplies, blankets, etc. The present carrier is structured to resemble an animal, preferably a mammal such as a horse or other farm animal or domestic pet which would be attractive to infants, toddlers and small children.

2. Description of the Prior Art

Innumerable carriers for various articles have been developed over the years, from pocketed clothing to backpacks, purses, wallets, and other devices. However, with the ever increasing numbers of articles developed specifically for the care of infants and toddlers, a parent or guardian is increasingly burdened when he or she travels with the child. While various carriers and containers have been developed for the carriage and storage of such infant care articles, most are devoted to only a single type of article (e.g., baby bottles or other food, diapers, etc.), or at most, a very few types of basic articles. While various containers resembling animals have been developed in the past, none of these previously developed containers appear to provide the utility and versatility of the present container, as will be seen in the discussion below of the related art known to the inventor.

Previously patented carriers and bags, as exemplified by U.S. Pat. No. 4,886,150, issued on Dec. 12, 1989 to Julie-Anna Fitzsimmons, U.S. Pat. No. 5,215,172, issued on Jun. 1, 1993 to Anthony B. Stevenson, and U.S. Pat. No. 5,439,154, issued on Aug. 8, 1995 to Anna Delligatti, all have generally thin, flat, rectangular structures which are generally incapable of carrying all of the articles commonly associated today with infants and toddlers. While the Stevenson device provides a case-like enclosure which has somewhat more volume than the other devices, it is incapable of carrying a significant number of accessories and the like due to the built in headrest and rigid diaper changing surface therein. In any event, none of these devices provides a pleasing and attractive appearance for an infant or toddler, as provided by the present invention.

U.S. Pat. No. 313,118, issued on Dec. 25, 1990 to Richard J. Maddocks, U.S. Pat. No. 313,697, issued on Jan. 15, 1991 to Catherine M. Senitt, U.S. Pat. No. 313,887, issued on Jan. 22, 1991 to Catherine M. Senitt, U.S. Pat. No. 324,302, issued on Mar. 3, 1992 to Shirley E. Schneck, U.S. Pat. No. 324,304, issued on Mar. 3, 1992 to Catherine M. Senitt, U.S. Pat. No. 345,649, issued on Apr. 4, 1994 to Maria E. Beltempo, U.S. Pat. No. 352,391, issued on Nov. 15, 1994 to Maria E. Beltempo, and U.S. Pat. No. 358,476, issued on May 23, 1995 to Gloria J. Winkos, show cases and bags simulative of animals. However, none of these containers appears to have the numerous specialized compartments of the instant invention.

United Kingdom Patent Publication No. 2,054,388, published on Feb. 18, 1981, and World Organization Patent Publication No. 87/02554, published on May 7, 1987, lack the storage capacity and the configuration of the present invention. In the case of the device of the UK patent publication, no space is provided for the storage of one or more relatively bulky blankets, and the device of the World patent publication provides only for diaper changing and bottle storage, with no provision for other articles. Moreover, none of the devices disclosed in the above described U.S. utility patents or the two foreign patent references provides any legs to support the container body and to lift it to a more practicable height, as provided by the present invention.

None of the above inventions and patents, taken either singly or in combination, is seen to describe the instant invention as claimed.

SUMMARY OF THE INVENTION

The present invention comprises a carrying bag simulative of an animal and having numerous compartments, pockets, and trays for holding items for the care of infants, toddlers, and/or small children. The carrier may have a smaller bag around its neck for holding a blanket or other item. The smaller bag may be related to the larger carrier by having a common theme or similar design, for example a horse configured carrier may have a smaller bag shaped like a feed bag or trough.

Accordingly, it is a principal object of the invention to provide a carrier for the carriage and storage of articles relating to the care of infants, toddlers, and/or small children.

It is another object of the present invention to provide a carrier having a relatively large storage capacity and relatively good versatility for the carriage of numerous different articles.

It is yet another object of the invention to provide a carrier that is simulative of an animal and will be a novelty to children.

Still another object of the present invention is to provide a carrier having both internal and external storage compartments.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a carrier for items or articles related to the care of infants, toddlers, and/or small children.

More and more articles, supplies, toys, etc. are generally considered to be necessary in the care of the very young, particularly during any form of travel away from the home for more than a couple of hours or so, and more particularly during extended travel. The present carrier 10 provides a means of carrying and storing virtually any type of article or item which might be required in the care of an infant or small child, in a single storage unit resembling an animal which is attractive to such a small child.

Figure 1:
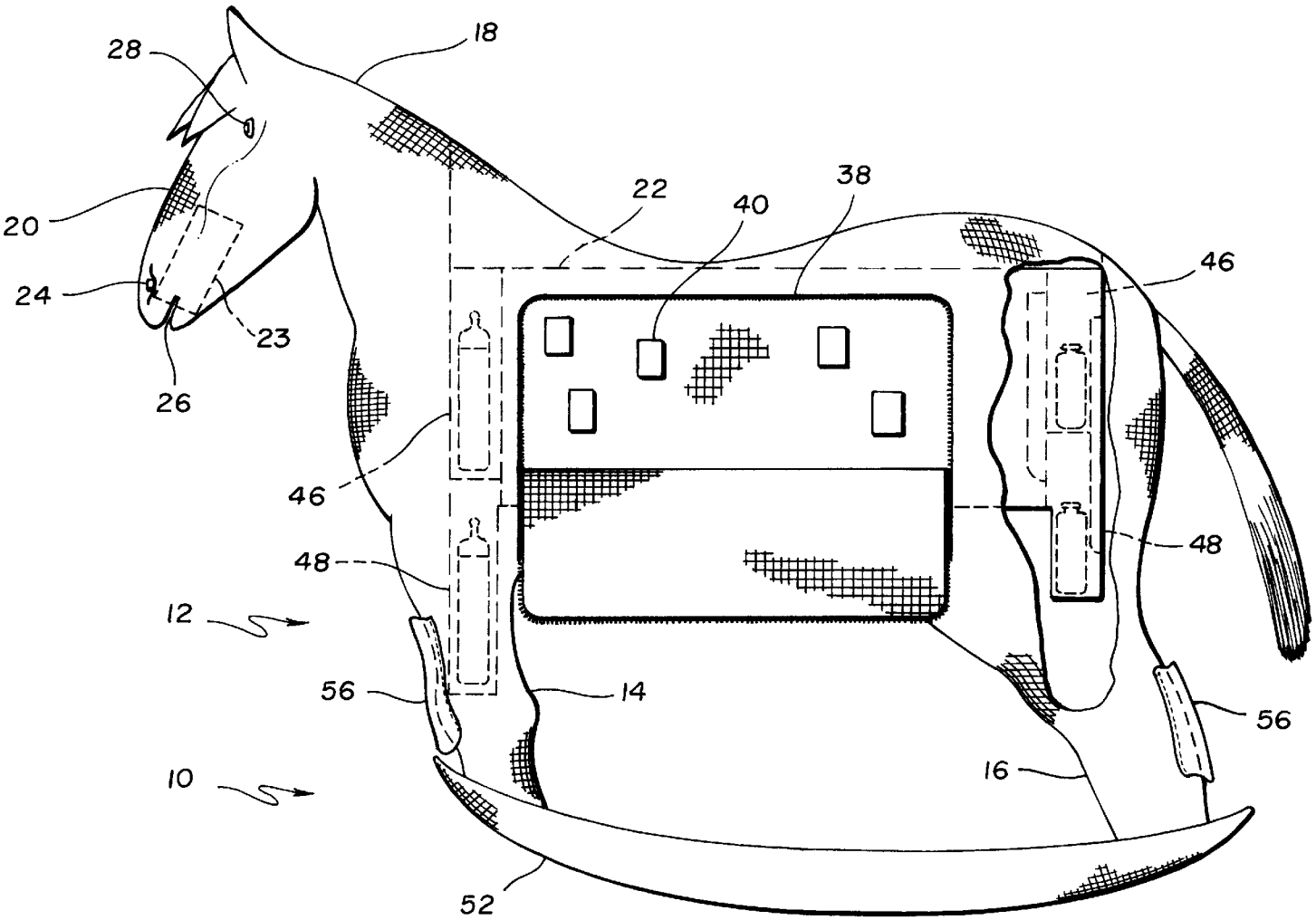
FIG. 1 is a left side elevational view of the present carrier, with a portion thereof being removed to show internal structure.

FIG. 1 shows a carrier 10 for such articles for infants and small children, and having a body 12 simulative of a horse. The body 12 includes a front and a rear leg, respectively 14 and 16, a neck 18, and a head 20. It should be noted, that the term "leg" does not describe a pair of front legs and a separate pair of rear legs, but that the front leg 14 comprises a single, relatively wide structure depending from the forward portion of the body of the carrier. In a similar manner, the rear leg 16 is also a single, relatively wide structure depending from the rear portion of the carrier. This structure provides good structural strength for the present carrier, and also provides additional vertically disposed storage volume within each of the legs 14 and 16, as noted below.

The legs 14 and 16 are hollow and capable of storing items such as vertically disposed compartments 46 and 48, shown in FIG. 3 and discussed in detail further below. As noted above, in the preferred embodiment, the front legs 14 are combined into one storage unit, with the rear legs 16 being similarly configured. This configuration provides a continuous forward and rearward lateral volume for the placement of lower storage racks 48 therein, as discussed further below and shown in detail in FIG. 3. The lower racks 48 and upper racks 46 each fit into forward and rearward lower extensions of the tray 22, which extends substantially the length and width of the internal body cavity or volume 42 of the carrier 10. In another embodiment, the legs may be separate, i.e., two front legs 14, 14 and two rear legs 16, 16, with four separate storage areas therein.

If desired, some form of musical entertainment (radio, cassette player, compact disc player) may be included within the present carrier 10. The neck 18 and head 20 portions do not provide particularly efficient storage space for various frequently accessed or removed articles, and thus may be used to contain such a sound system, with the controls for the audio system being positioned in the head portion 20 for ease of access. The head 20 may include a musical entertainment device 23 controlled by knobs simulative of the animal's nose or nostrils 24, 24 and eyes 28, 28. The musical device 23 may be either a radio or a cassette or compact disc player. In the event that the musical device 23 is a cassette or a disc player it may be positioned in the head 20 so the cassette 30 (shown in FIG. 2) or the disc may be inserted into the animal's mouth 26.

Figure 2:
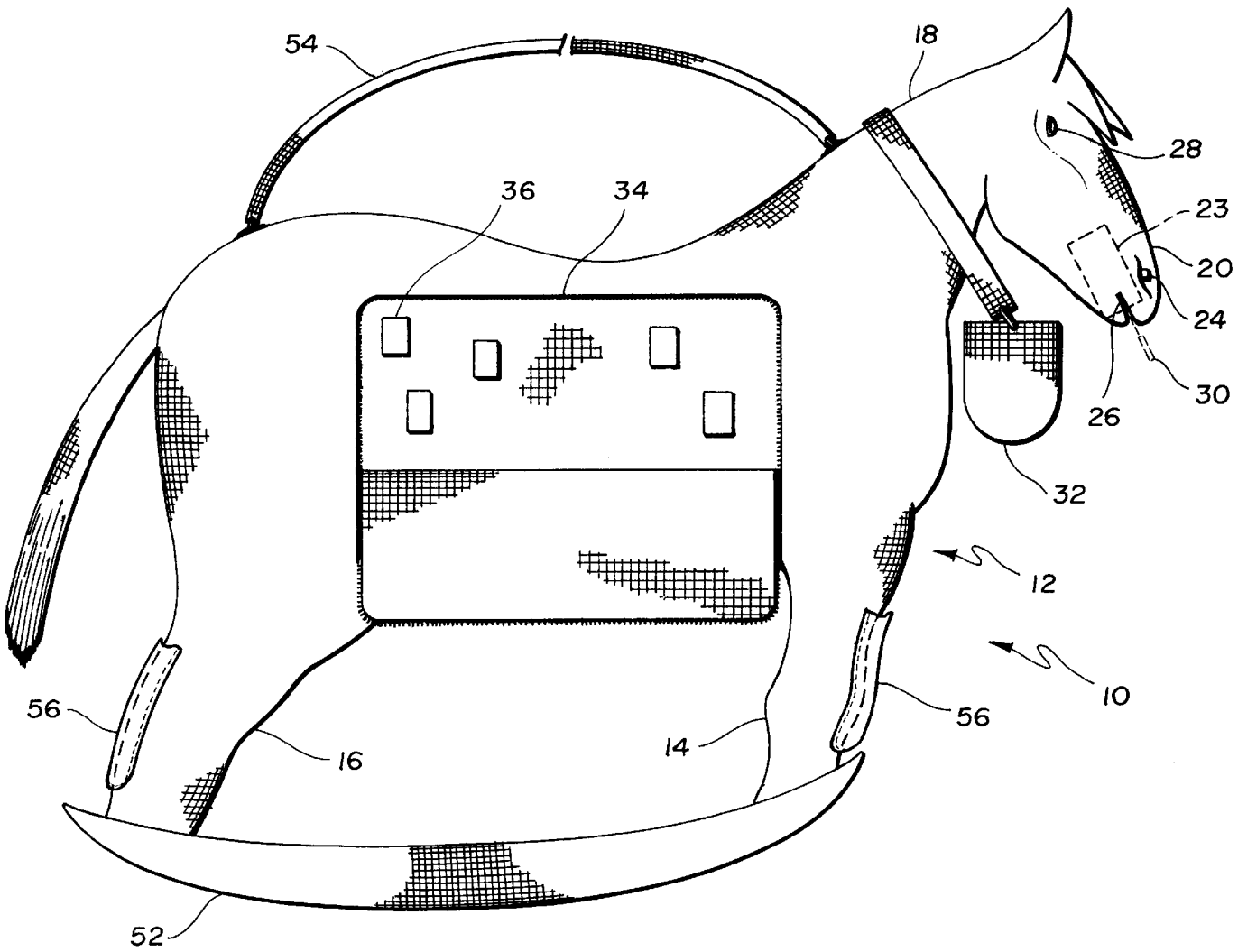
FIG. 2 is a right side elevational view of the carrier with the side compartment of the carrier in an open position, with a supplemental bag being shown about the neck of the carrier animal.

Referring to FIG. 2, a smaller bag or supplemental container 32 may be removably placed around the neck 18 of the carrier 10 for storing a receiving blanket. Alternatively, the receiving blanket can be removed from the smaller bag 32 and it can be used to store the items usually stored in the larger carrier bag 12, so that only the smaller bag 32 need be carried. For the illustrated bag 12 simulative of a horse, the small bag 32 is simulative of a feed bag. This bag 32 may be different for each animal, e.g. if the large bag 12 represents a dog, cat, or bear, the small bag may be a barrel (carried by St. Bernards) , a cat bell, or a honey jar, respectively. Carriers 12 simulative of cows or pigs could have a small bag or supplemental container 32 which is simulative of a trough.

Figure 4:
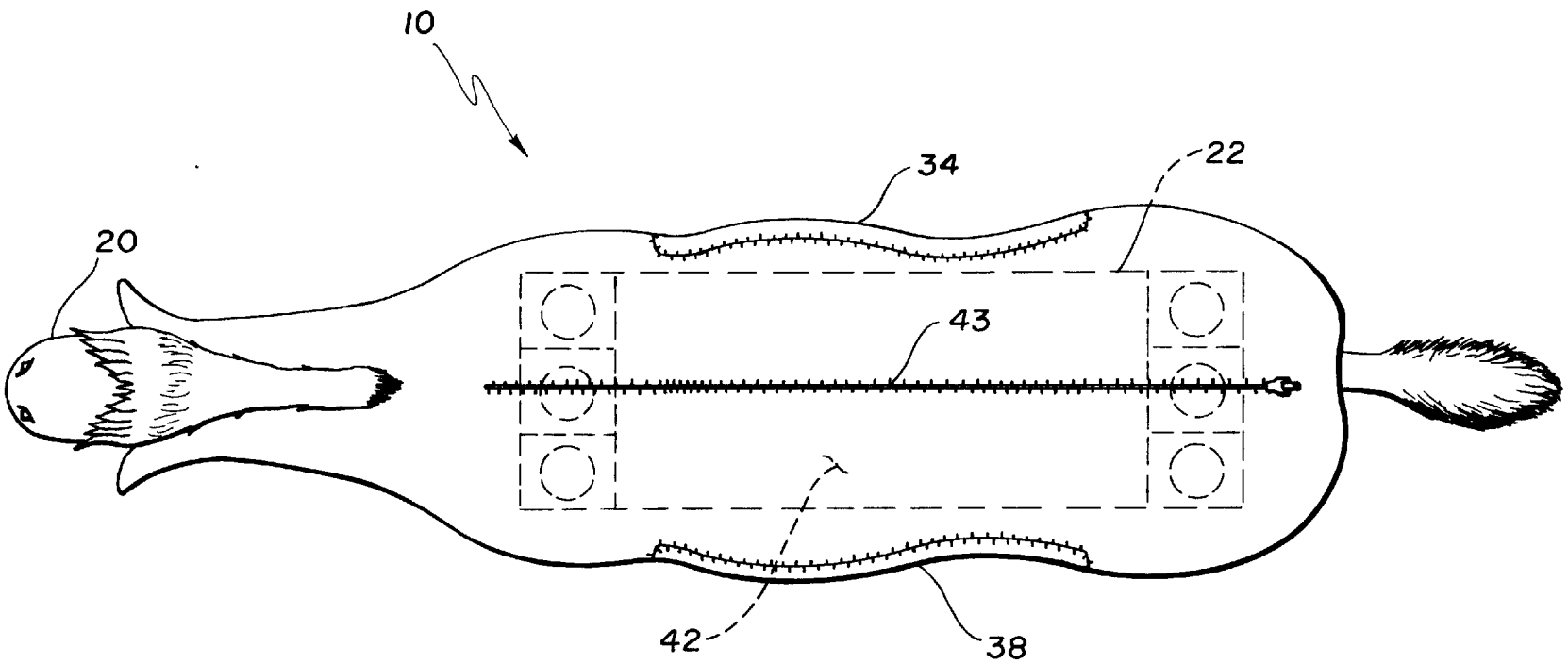
FIG. 4 is a top plan view of the present carrier, showing further details thereof.

Further storage includes a first or right side pocket 34 disposed on the first or right side of the body portion, which pocket 34 may be opened to reveal individual compartments or pockets 36 for storing items such as brushes, rattles and/or other toys, etc. A second or left side pocket 38 and compartments or pockets 40 are disposed along the second or left side of the body portion, as shown in FIG. 1. A center pocket 42 (shown in FIG. 4) is accessed by an upper closure (e. g., zipper 43, snaps, etc.) for access to the main interior volume of the carrier 10. Access to the tray 22 and racks 46 and 48 stored in the forward or rearward ends of the carrier 10, and at least partially into the forward and rearward leg groups 14 and 16 thereof, is also provided through this upper opening 43 to the center pocket or volume 42.

Figure 3:
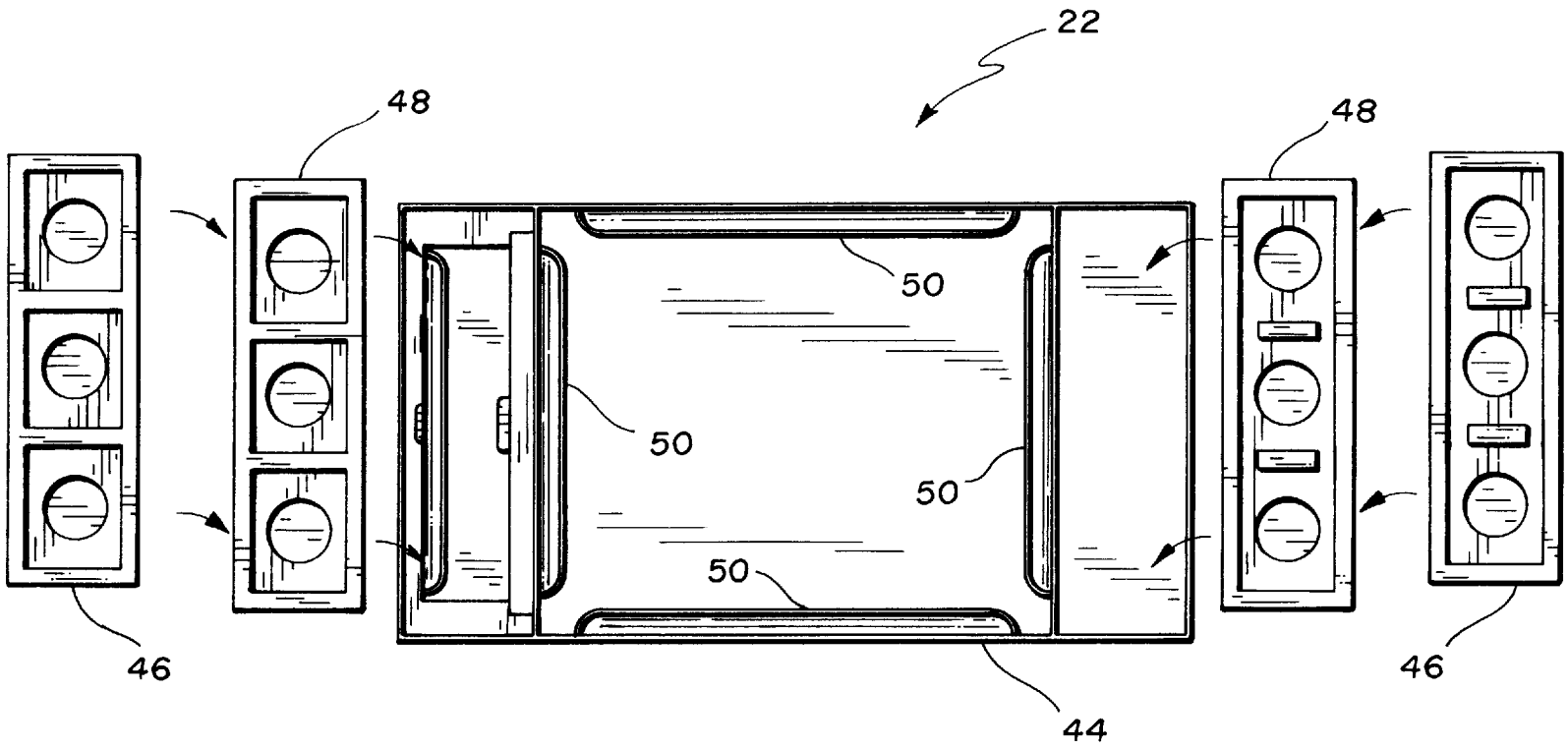
FIG. 3 is a top plan view of the internal tray and bottle holder compartments of the present carrier.

The tray 22 is shown in detail in FIG. 3. The tray 22 includes a main portion 44 which may be used to store items such as clothing and/or other relatively bulky and soft materials which may be folded to fit the main portion 44. On either end of the main portion 44 are upper and lower bottle storage racks or trays 46 and 48 for storing jars of baby food, bottles of water or milk, etc. These supplemental racks or trays 46 and 48 may be insulated in order to maintain the desired temperature of a food or other article placed therein. Pockets 50 inside the carrier bag 12 are for storing items such as wet diapers, bibs, or anything else that needs to be contained. The main tray 22 may be permanently installed within the interior cavity 42 of the carrier 10, in order to add some structural rigidity to the carrier 10, or may alternatively be removable therefrom. The supplemental forward and rearward upper storage racks 46 and lower storage racks 48 are removable from the depending forward and rearward ends of the tray 22, as desired.

The above described carrying container 10 is preferably formed of relatively soft and pliable materials, with some internal structure (such as the tray 22 and its forward and rearward depending end portions providing for the storage of supplemental tray racks 46 and 48) providing the desired rigidity to enable the carrier 10 to stand upright. This provides good access to the interior storage areas 34, 38, and 42 and retains the carrier 10 in the desired upright position. Optionally, the carrier 10 may also include rockers 52 FIGS. 1 and 2) to tie the forward and rearward leg components 14 and 16 together for greater structural rigidity, and to provide the appearance of a rocking horse for a carrier 10 resembling a horse. Other bases may be provided for carriers resembling other animal species, as desired. A carrying strap 54 may also be provided if desired, as seen in FIG. 2. Additional external storage pockets 56 may also be provided along the leg portions 14 and 16, as shown in FIGS. 1 and 2.

In summary, the present carrier for items will be seen to provide a most useful accessory for parents or others caring for infants and toddlers. The present carrier contains sufficient space for the carriage of virtually any and all articles which might conceivably be required for the care and entertainment of a very small child, including various types of food, medication, diapers, blankets, etc., as desired. The external configuration of the present carrier, with its resemblance to an animal attractive to a small child, provides greater interest to such a child when the child observes a parent or guardian readying the present carrier for a trip. It will be seen that the present container or bag may be formed in a configuration resembling other characters, either fictional or real, as desired. In the event the infant or child must be subjected to a less than pleasant experience (e.g., the taking of a medication having a less than pleasing flavor, etc.), the association with an animal or other character which has pleasant associations for the child, will make the undesirable event at least somewhat more pleasant. Accordingly, parents and guardians of infants, toddlers, and very small children will find the present carrier to be a most desirable and practical accessory.

It is to be understood that the present invention is not limited to the embodiments described above, but encompasses any and all embodiments within the scope of the following claims.

I claim:

1. A carrier for items, comprising:

a bag having a main body portion with a first and an opposite second side, a forward leg portion, a rearward leg portion, a neck portion, and a head portion;

a first and an opposite second side pocket respectively disposed along said first and said second side of said main body portion;

a center pocket disposed within said main body portion;

said side pockets and said center pocket each including interior pockets for storing items; and said center pocket including at least one tray for storing items therein.

2. The bag of claim 1, wherein said bag is simulative of an animal.

3. The bag of claim 1, wherein said forward leg portion and said rearward leg portion each include storage volume therein for storing items therein.

4. The bag of claim 1, including an upper forward, upper rearward, lower forward, and lower rearward storage racks for removably placing within said forward and said rearward leg compartments.

5. The bag of claim 1, including a first and a second rocker each extending from said forward to said rearward leg portion.

6. The bag of claim 1, including a musical device disposed within said head portion of said bag.

7. The bag of claim 6, wherein said head portion includes controls for regulating said musical device, with said controls having a disposition and appearance corresponding to eyes and nose.

8. The bag of claim 6, wherein said musical device is a tape player and said head portion includes a mouth for receiving a tape.

9. The bag of claim 1, including a supplemental container for removably installing about said neck portion of said bag.

10. The bag of claim 9, wherein said supplemental container is consistent in design with said bag.

11. The bag of claim 1, including external storage pockets disposed upon said forward and said rearward leg portions.

12. A carrier comprising:

a bag simulative of an animal and including front and rear legs, a neck, and a head;

said legs each including item storage volume for storing items therein;

said neck including a removable supplemental storage container consistent in design with said animal simulation;

said head including a musical device with eyes and a nose, with said eyes and said nose being controls for regulating said musical device;

said bag including a pair of side pockets and a center pocket, with said side pockets and said center pocket each including interior pockets for storing items, and said center pocket including at least one tray for storing items; and a first and a second rocker each extending from said front legs to said rear legs.

13. The bag of claim 12, wherein said musical device is a tape player and said head includes a mouth for receiving a tape.

14. The bag of claim 12, including an upper forward, upper rearward, lower forward, and lower rearward storage rack for removably placing within said leg compartments.

15. The bag of claim 12, including external storage pockets disposed upon said forward and said rearward leg portions.

* * * * *